US006959837B2

(12) United States Patent
Shermer et al.

(10) Patent No.: US 6,959,837 B2
(45) Date of Patent: Nov. 1, 2005

(54) DUAL PISTON/POPPET FLOW SWITCH

(75) Inventors: William P. Shermer, Greensboro, NC (US); Seifollah S. Nanaji, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 246 days.

(21) Appl. No.: 10/819,747

(22) Filed: Apr. 7, 2004

(65) Prior Publication Data

US 2004/0187954 A1 Sep. 30, 2004

Related U.S. Application Data

(62) Division of application No. 10/389,377, filed on Mar. 14, 2003, now Pat. No. 6,763,974.

(51) Int. Cl.[7] ..... F18K 17/00

(52) U.S. Cl. ..... 222/41; 137/553; 137/559; 141/94

(58) Field of Search ..... 222/41; 137/553, 137/559; 141/94

(56) References Cited

U.S. PATENT DOCUMENTS

| | | | | |
|---|---|---|---|---|
| 2,678,658 | A | 5/1954 | Rittenhouse | 137/235 |
| 2,773,251 | A | 12/1956 | Snyder | |
| 3,524,465 | A | 8/1970 | Sadler | 137/115 |
| 3,724,808 | A | 4/1973 | Sugden, Jr. | 251/30 |
| 4,343,336 | A | 8/1982 | Trygg | 141/218 |
| 4,397,405 | A | 8/1983 | Batson | 222/14 |
| 4,487,238 | A | 12/1984 | Carder, Sr. | 141/206 |
| 4,559,982 | A | 12/1985 | Fink, Jr. | 141/206 |
| 4,978,029 | A | 12/1990 | Furrow et al. | 222/1 |
| 5,178,197 | A | 1/1993 | Healy | 141/217 |
| 5,421,545 | A | 6/1995 | Schexnayder | 251/30.02 |
| 5,689,071 | A | 11/1997 | Ruffner et al. | 73/861.84 |
| 6,173,734 | B1 | 1/2001 | Olivas et al. | 137/460 |
| 6,382,246 | B2 * | 5/2002 | Mori et al. | 137/554 |
| 6,412,510 | B1 | 7/2002 | Johnson | 137/14 |
| 6,435,204 | B2 | 8/2002 | White et al. | 137/234.6 |

FOREIGN PATENT DOCUMENTS

| | | |
|---|---|---|
| DE | 698496 | 11/1940 |
| DE | 197 14 587 C1 | 5/1998 |

OTHER PUBLICATIONS

"Standard and Safety, Power–Operated Dispensing Devices For Petroleum Products", Underwriters Laboratories Inc., UL 87, Ninth Edition, 1990, pp. 9–10.

"Standard and Safety, Power–Operated Pumps", Underwriters Laboratories Inc., UL 79, 1981, p. 8.

* cited by examiner

*Primary Examiner*—J. Casimer Jacyna
(74) *Attorney, Agent, or Firm*—Withrow & Terranova, PLLC

(57) ABSTRACT

A dual piston/poppet valve in a fuel dispenser works with a two-stage valve to help eliminate errors from an inferential flow meter. When the two-stage valve opens partially, a secondary fuel path is opened in the dual piston/poppet valve. A sensor detects the opening of the secondary fuel path and reports its opening to a control system. The two-stage valve opens fully and a primary fuel path is opened concurrently. During transaction completion, the two-stage valve partially closes, resulting in the closing of the primary fuel path. When the two-stage valve closes completely, the secondary fuel path closes. The sensor detects the closing of the secondary fuel path and reports the closing to the control system. Based on the outputs of the sensor, the control system accepts or declines input from a flow meter.

10 Claims, 10 Drawing Sheets

DUAL PISTON/POPPET FLOW SWITCH

The present application is a divisional of U.S. patent application Ser. No. 10/389,377, filed Mar. 14, 2003, now U.S. Pat. No. 6,763,974.

FIELD OF THE INVENTION

The present invention relates to a flow switch in a fuel dispenser that is adapted to operate in high flow and low flow situations.

BACKGROUND OF THE INVENTION

In a typical transaction, a consumer may drive a vehicle up to a fuel dispenser in a fueling environment. The consumer arranges for payment, either by paying at the pump, paying the cashier with cash, using a credit card or debit card, or some combination of these methods. The nozzle is inserted into the fill neck of the vehicle and fuel is dispensed into the gas tank of the vehicle. Displays on the fuel dispenser track how much fuel has been dispensed as well as a dollar value associated with the fuel that has been dispensed. The customer relies on the fuel dispenser to measure the amount of fuel dispensed accurately and charge the customer accordingly. One method customers sometimes use to control costs is to pay for a preset amount of fuel based on a dollar or volume amount. Regulatory requirements, namely Weights & Measures, require that these customers receive all of the fuel for which they have paid to a highly accurate degree.

Operating behind the scenes of this process are valves that open and close the fuel flow path and a flow meter that measures the amount of fuel dispensed. The purpose of the flow meter is to measure accurately the amount of fuel that is being delivered to the customer so that the customer may be billed accordingly and inventory tracking may be undertaken. As noted, for preset dollar or volume transactions, the consumer relies on the flow meter to measure the fuel dispensed so as to know when to terminate the fuel flow. Some meters are inferential meters, meaning that the actual displacement of the fuel is not measured. Inferential meters have some advantages over positive displacement meters. Chief among these advantages is that inferential meters typically are smaller than positive displacement meters. One example of an inferential meter that may be used is described in U.S. Pat. No. 5,689,071, entitled "WIDE RANGE, HIGH ACCURACY FLOW METER." The '071 patent describes a turbine flow meter that measures the flow rate of a fluid by determining the number of rotations of a turbine rotor located inside the flow path of the meter.

As fluid enters the inlet port of the turbine flow meter in the meter of the '071 patent, the fluid passes across two turbine rotors, which causes the turbine rotors to rotate. The rotational velocity of the turbine rotors is sensed by pick-off coils. The pick-off coils are excited by an a-c signal that produces a magnetic field. As the turbine rotor rotates, the vanes on the turbine rotors pass through the magnetic field generated by the pick-off coils, thereby superimposing a pulse on the carrier waveform of the pick-off coils. The superimposed pulses occur at a repetition rate (pulses per second) proportional to the rotors' velocity and hence proportional to the measured rate of flow.

A problem may occur when using a turbine flow meter. When fuel flows across the rotors, the rotors acquire some rotational momentum. When the fuel flow stops, the rotational momentum causes the turbine rotors to continue to rotate, despite the absence of fuel flow. This continued movement causes the turbine flow meter to continue generating measurement signals as if fuel were still flowing. The control system that receives the measurement signals from the pick-off coils of the turbine flow meter continues to register fuel flow falsely.

A solution to the aforementioned problem must be found to use a turbine flow meter as an accurate flow meter in a fuel dispenser. The present invention provides a solution to this problem.

The fact that not all valves that open and close the fuel flow path are well suited for preset cost or preset volume transactions is also of concern when designing fuel dispensers. Typically, to assist consumers in dispensing a fuel amount corresponding to the preset amount, some fuel dispensers are equipped with a two stage valve that allows high flow conditions throughout the majority of a fueling transaction and slow flow conditions at the terminating portion of the transaction. In slow flow conditions, the rate of fuel being dispensed slows dramatically to enable the dispenser to hit the predetermined volume or desired monetary amount. The slow flow portion of a preset transaction generates a consistent flow-rate so that the two stage valve may be de-energized at the proper time to achieve the desired termination point. In this manner, the consumer may stop squeezing the nozzle handle at the appropriate time when the desired amount of fuel is dispensed. To date, the two-stage valves that achieve the slow flow and high flow conditions work reasonably well, but may not be optimized to interact with inferential flow meters. Thus, any solution that improves the use of an inferential flow meter should also address this concern.

SUMMARY OF THE INVENTION

The present invention provides a technique through which a control system in a fuel dispenser is cognizant of when fuel is flowing so that the control system may ignore extraneous signals from a flow meter. This allows the use of inferential turbine flow meters in fuel dispensers without the risk of a false reading in the amount of fuel dispensed. This technique is achieved by providing a dual piston/poppet flow switch in the fuel path within the fuel dispenser that works well in both slow flow and high flow conditions.

The dual piston/poppet flow switch acts as a valve. The valve operates in one of three modes. The first mode is the fully closed mode where both pistons are closed and no fuel flows through the valve. The valve has an optional indicator that informs the fuel dispenser control system if the valve is in this mode. The second mode is a slow flow open mode. In this mode, a secondary or bypass fuel path is open and fuel flows relatively slowly through the valve. The indicator, if present, tells the control system that the bypass fuel path is open and thus, the control system knows to accept inputs from the flow meter as non-spurious. The third mode is a high flow open mode. In this mode, a primary fuel path is open concurrently with the secondary fuel path, and fuel flows quickly through the valve. Because the secondary fuel path is open, the indicator, if present, tells the control system to accept input from the flow meter. The two fuel path arrangement helps optimize the valve for use with an inferential flow meter in slow flow and high flow situations regardless of the existence of the indicator. The indicator helps the control system of the fuel dispenser know when to accept inputs from the flow meter.

The valve has a housing with a primary fuel flow path on a primary axis of the housing. The primary fuel flow path is blocked by a normally closed primary piston. The primary piston is kept normally closed by a primary spring. A secondary fuel flow path routes around the primary piston. The secondary fuel flow path is blocked by a normally closed secondary piston. The secondary piston is likewise kept normally closed by a secondary spring. The force required to open the secondary piston is comparatively less than that required to open the primary piston. The secondary piston is also connected to a magnet or other position sensible element that acts as the indicator such that movements of the secondary piston may be detected.

In use, the valve initially receives fuel at a slow rate. This fuel hits the primary piston and is blocked. The fuel is thus shunted into the secondary fuel flow path where the fuel encounters the secondary piston. The secondary spring on the secondary piston is weak enough such that the slow rate of fuel is sufficient to compress the secondary spring, thereby opening the secondary fuel flow path. Opening the secondary piston moves the position sensible element such that a sensor may detect the movement of the position sensible element. The rate of fuel flow increases until the pressure on the primary piston is enough to compress the primary spring, thereby opening the primary fuel flow path. Fuel then flows through both the primary fuel path and the secondary fuel path during the majority of the fueling transaction.

As the fueling transaction ends, the process is reversed. The fuel flow rate slows, lowering the pressure on the primary piston. The primary spring closes the primary piston, leaving the secondary fuel path open. When the fuel flow is terminated, such as at the end of the transaction, the pressure on the secondary piston abates, and the secondary spring closes the secondary piston. The closing of the secondary piston moves the position sensible element, and the control system is informed to ignore further signals from the flow meter. Even when fuel flow is terminated abruptly and both pistons close at the same time, the movement of the position sensible element informs the control system to ignore further signals from the flow meter.

In exemplary embodiments, the indicator may be a Hall Effect sensor, an ultrasonic sensor, a magnetic reed switch, or the like, so as to help track the movement of the secondary piston.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention is directed to a valve that preferably operates in a fuel dispenser to acknowledge slow and high flow conditions. Before the valve is disclosed, an overview of a fueling system is herein presented. The novel structure of the valve is discussed beginning at FIG. 5 below.

Figure 1:
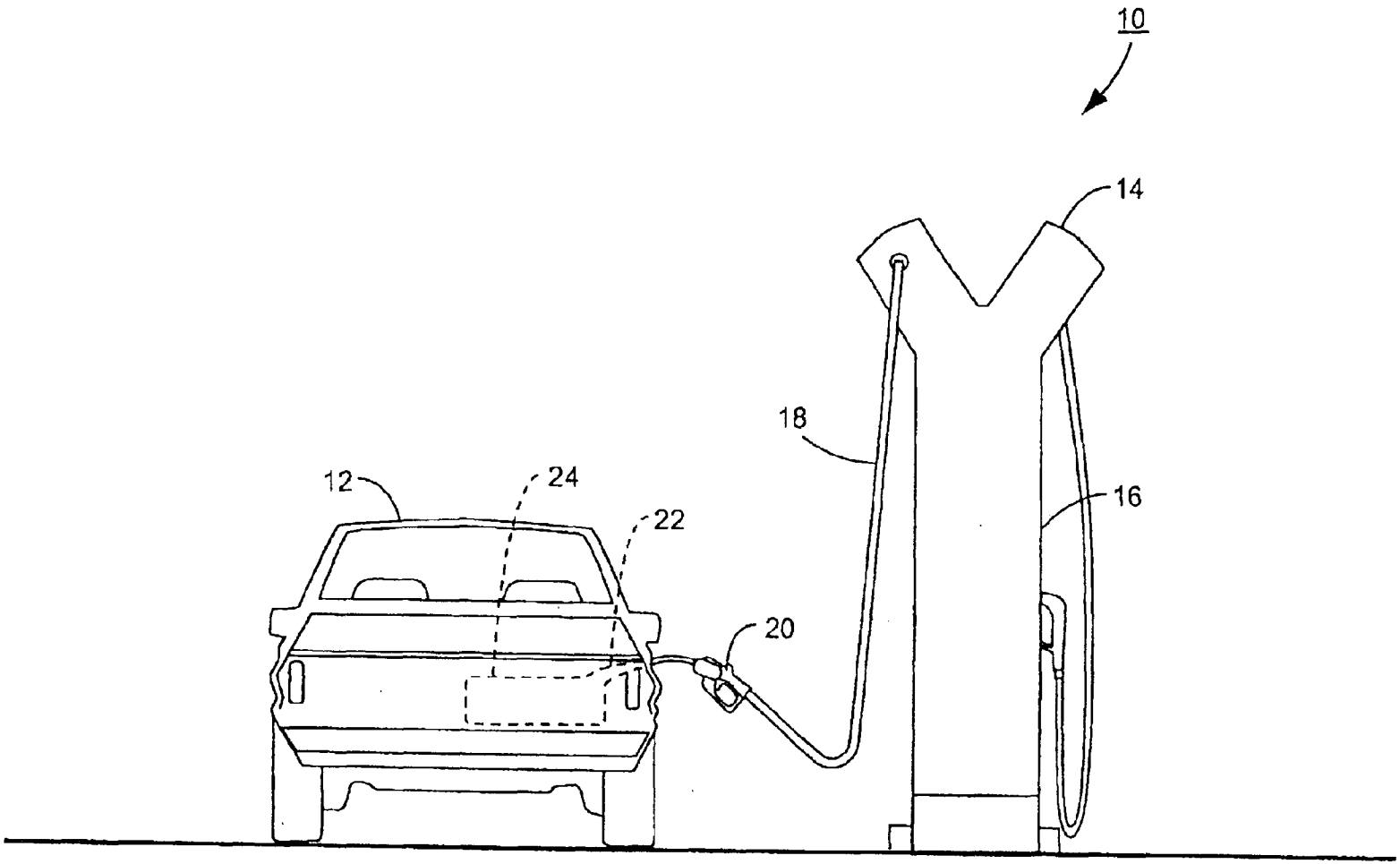
FIG. 1 PRIOR ART
FIG. 1 illustrates a fuel dispenser involved in a fueling transaction.

FIG. 1 illustrates a typical fueling environment 10 with a vehicle 12 being fueled by a fuel dispenser 14. The fuel dispenser 14 includes a housing 16 with a hose 18 extending therefrom. The hose 18 terminates in a manually operated nozzle 20 adapted to be inserted into a fill neck 22 of the vehicle 12. Fuel flows from an underground storage tank (not illustrated) through the fuel dispenser 14, out through the hose 18, down the fill neck 22 to a fuel tank 24 as is well understood. The fuel dispenser 14 may be the ECLIPSE® or ENCORE® sold by assignee of the present invention or other fuel dispensers as needed or desired such as that embodied in U.S. Pat. No. 4,978,029, which is hereby incorporated by reference in its entirety.

Figure 2:
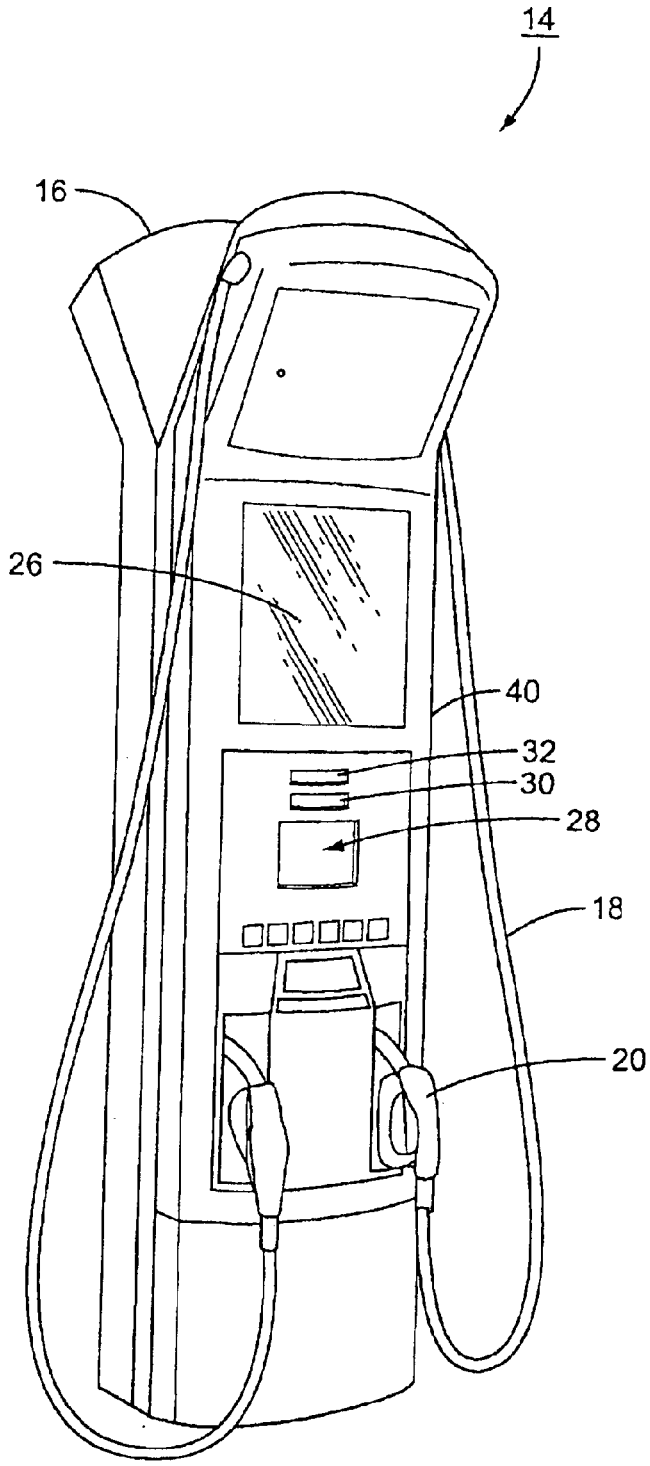
FIG. 2 PRIOR ART
FIG. 2 illustrates a partial front view of a fuel dispenser including its display.

The front of the fuel dispenser 14 is illustrated in FIG. 2. The fuel dispenser 14 may have a video display 26 proximate the top of the housing 16 and a second display 28 at eye level. The second display 28 may be associated with auxiliary information displays relating to an ongoing fueling transaction such as a number of gallons of fuel dispensed 30 and a price 32 corresponding to the fuel dispensed. The displays 26, 28, 30, 32 may include video capable screens or liquid crystal displays (LCDs) as needed or desired.

Figure 3:
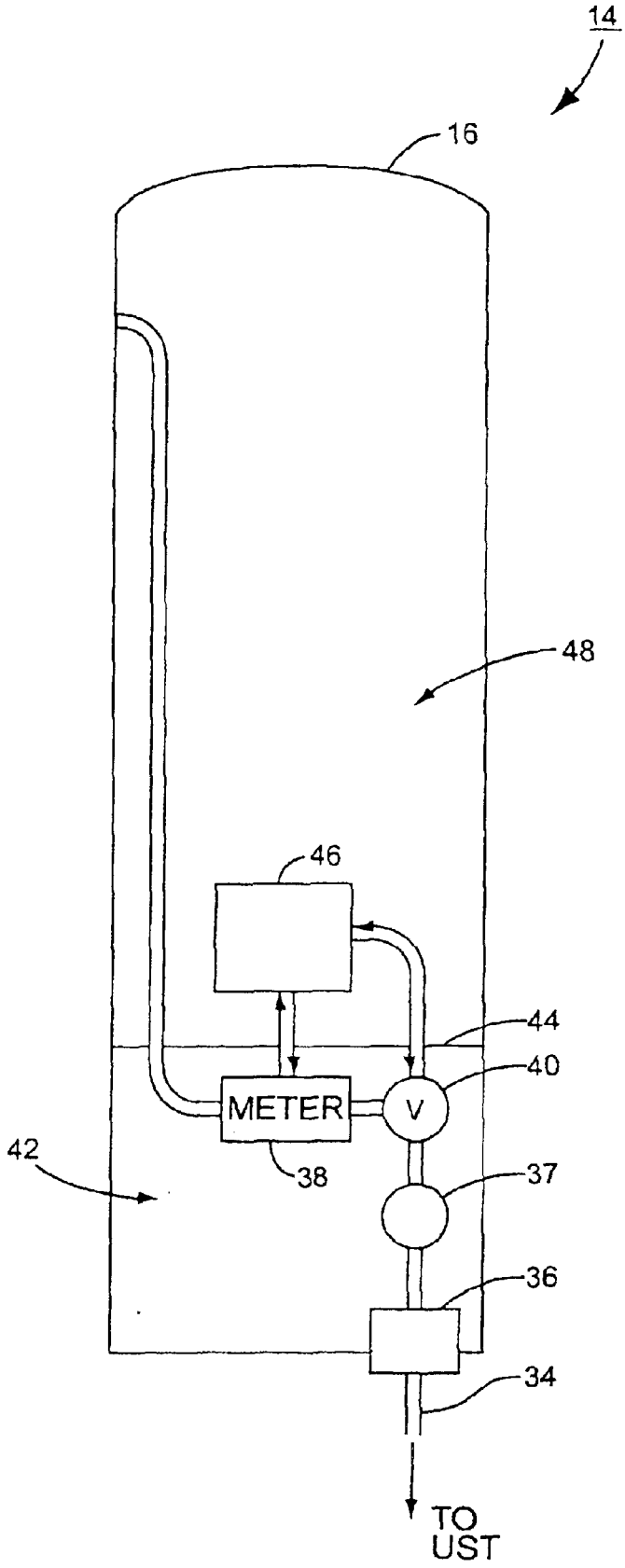
FIG. 3 illustrates a schematic view of a first embodiment of the fuel flow components of the fuel dispenser.

The present invention is well suited for use inside the housing 16 of a fuel dispenser 14. Specifically, the present invention is well suited for positioning in the fuel path of the fuel dispenser 14 as better illustrated in FIG. 3. Fuel may travel from the underground storage tank (UST, not illustrated) via a pipe 34, which may be a double walled pipe as is conventional in the fueling industry. An exemplary underground fuel delivery system is illustrated in U.S. Pat. No. 6,435,204, which is hereby incorporated by reference in its entirety. Pipe 34 may pass into the housing 16 through a shear valve 36. A two-stage valve 37 may be positioned in the fuel line. The two-stage valve 37 may be closed, such as when no fuel is flowing; open to a first degree, such as a slow flow condition; or open to a second degree, such as a high flow condition. An exemplary two-stage valve is illustrated in U.S. Pat. No. 3,724,808, which is hereby incorporated by reference in its entirety.

Figure 4:
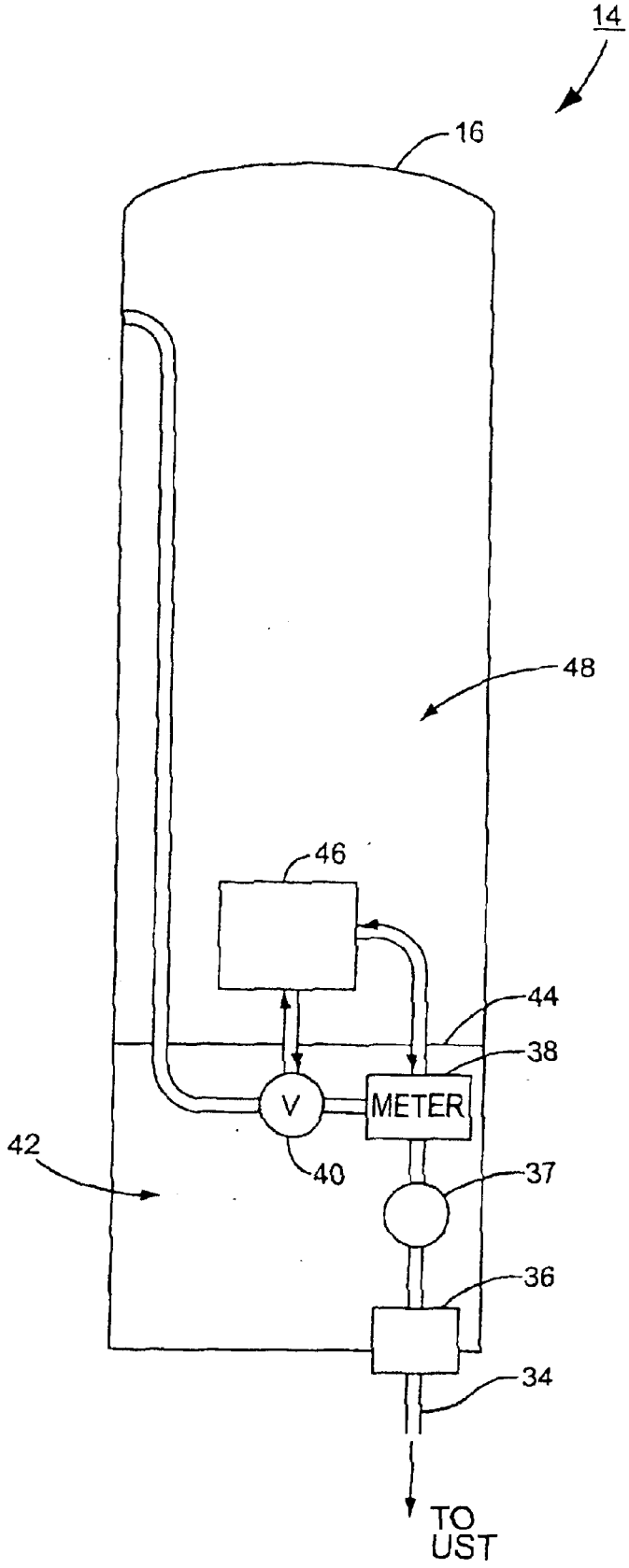
FIG. 4 illustrates a schematic view of a second embodiment of the fuel flow components of the fuel dispenser.

In most fuel dispensers 14, a submersible turbine pump associated with the UST is used to deliver fuel to the fuel dispenser 14. Some dispensers 14 may be self-contained, meaning fuel is drawn to the fuel dispenser 14 by a pump controlled by a motor (neither shown) positioned within the housing 16. A valve 40, according to the present invention, may be positioned upstream of a flow meter 38. Alternatively, the valve 40 may be positioned downstream of a flow meter 38 (see FIG. 4). The flow meter 38 and valve 40 are positioned in a fuel handling chamber 42 of the housing 16 as is well understood. The fuel handling chamber 42 is isolated from any sparks or other events that may cause combustion of fuel vapors as is well understood in the fueling industry.

The flow meter 38 and valve 40 communicate through a barrier 44 to a control system 46 positioned within an electronics chamber 48. An exemplary two-chambered fuel dispenser 14 is described in U.S. Pat. No. 4,986,445, which is hereby incorporated by reference in its entirety. The control system 46 may be a microcontroller, a microprocessor, or other electronics with associated memory and software programs running thereon as is well understood. The control system 46 controls other aspects of the fuel dispenser 14, such as the displays 26, 28, 30, 32 and the like, as is well understood. While not shown explicitly, it should be appreciated that the two-stage valve 37 is controlled by the control system 46. Specifically, the control system 46 can command the two-stage valve 37 to close, partially open, or open all the way to vary fuel flow rates between no flow, slow flow and high flow states.

Figure 5:
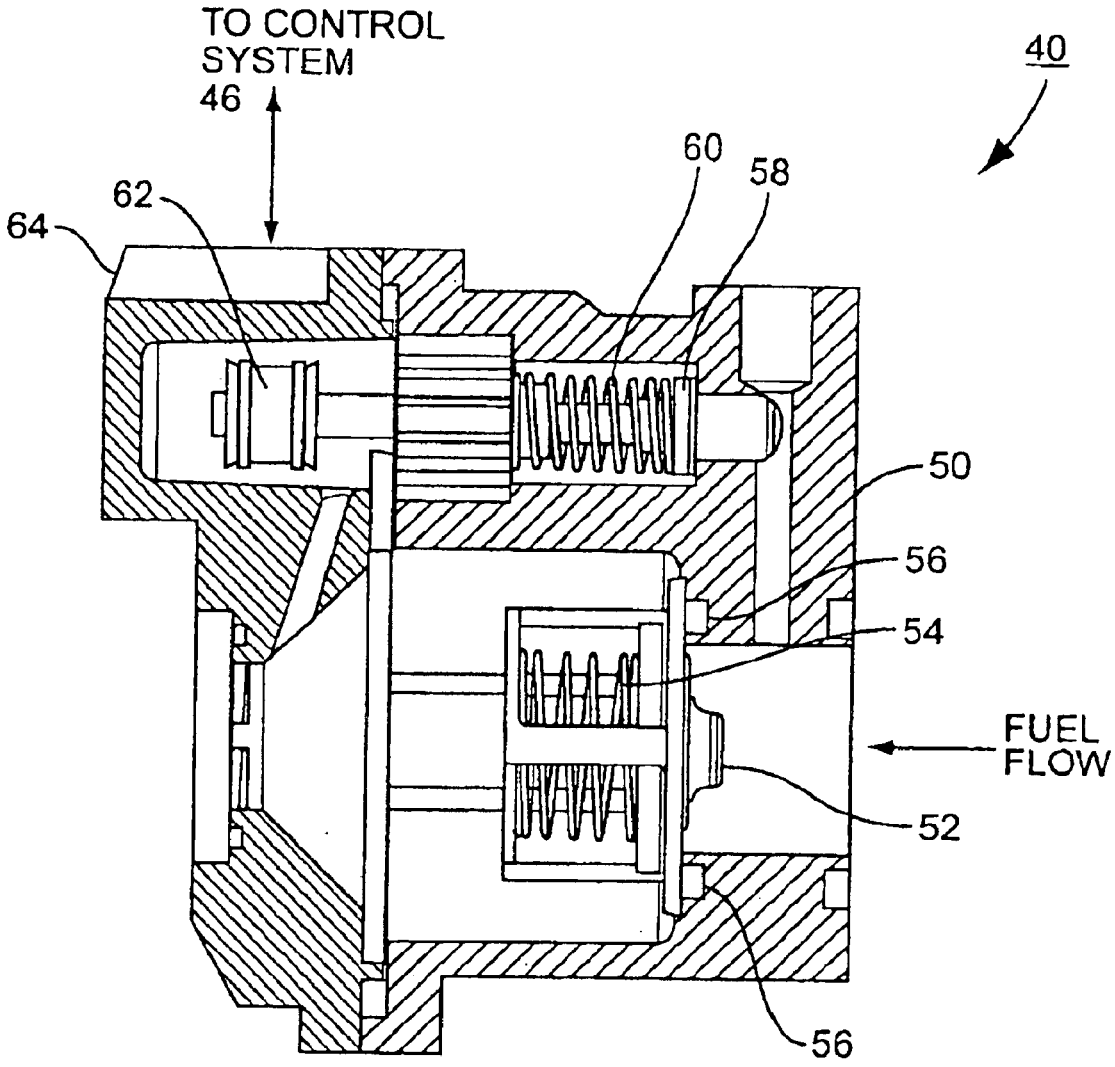
FIG. 5 illustrates a first embodiment of the valve of the present invention in a first, closed position.
Figure 6:
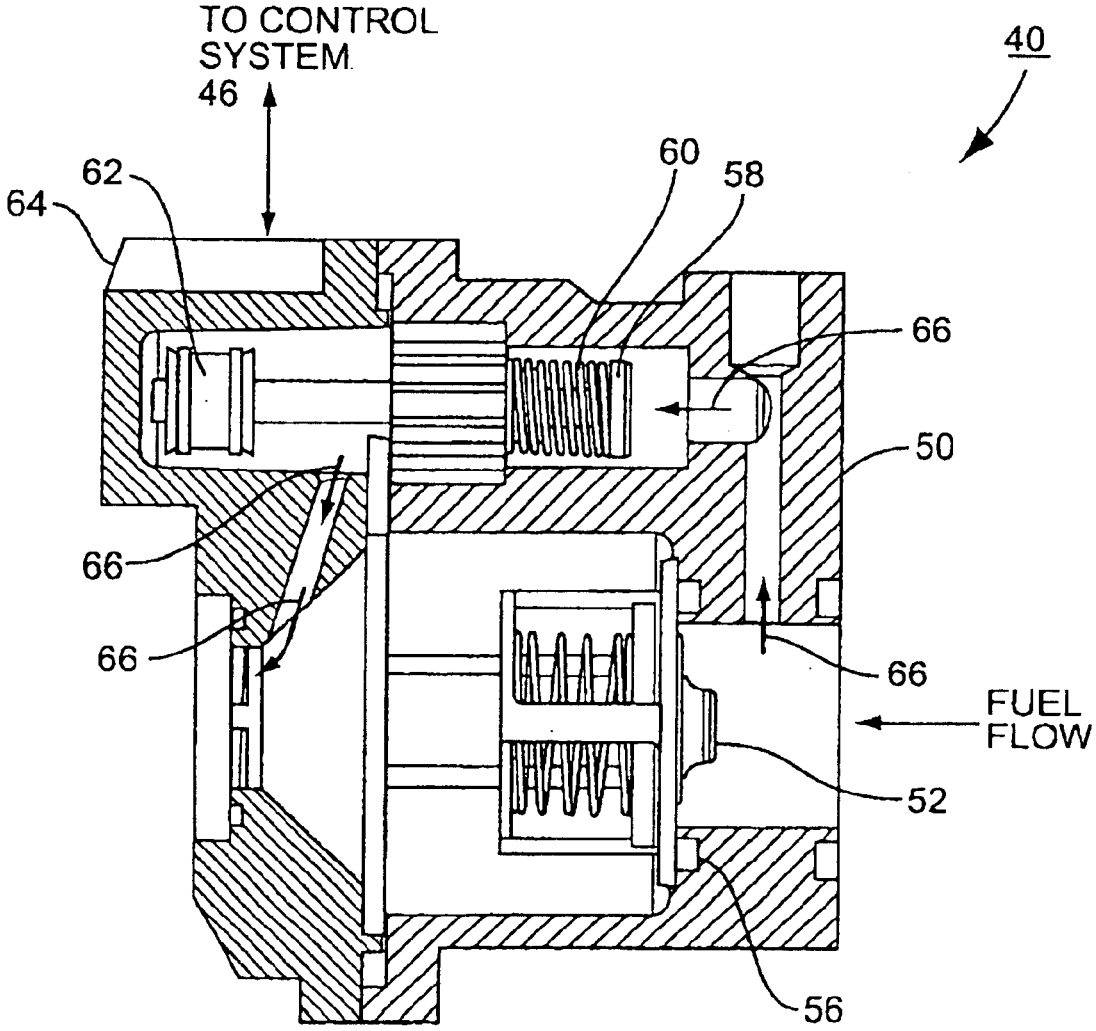
FIG. 6 illustrates the embodiment of FIG. 5 in a second, partially open position.
Figure 7:
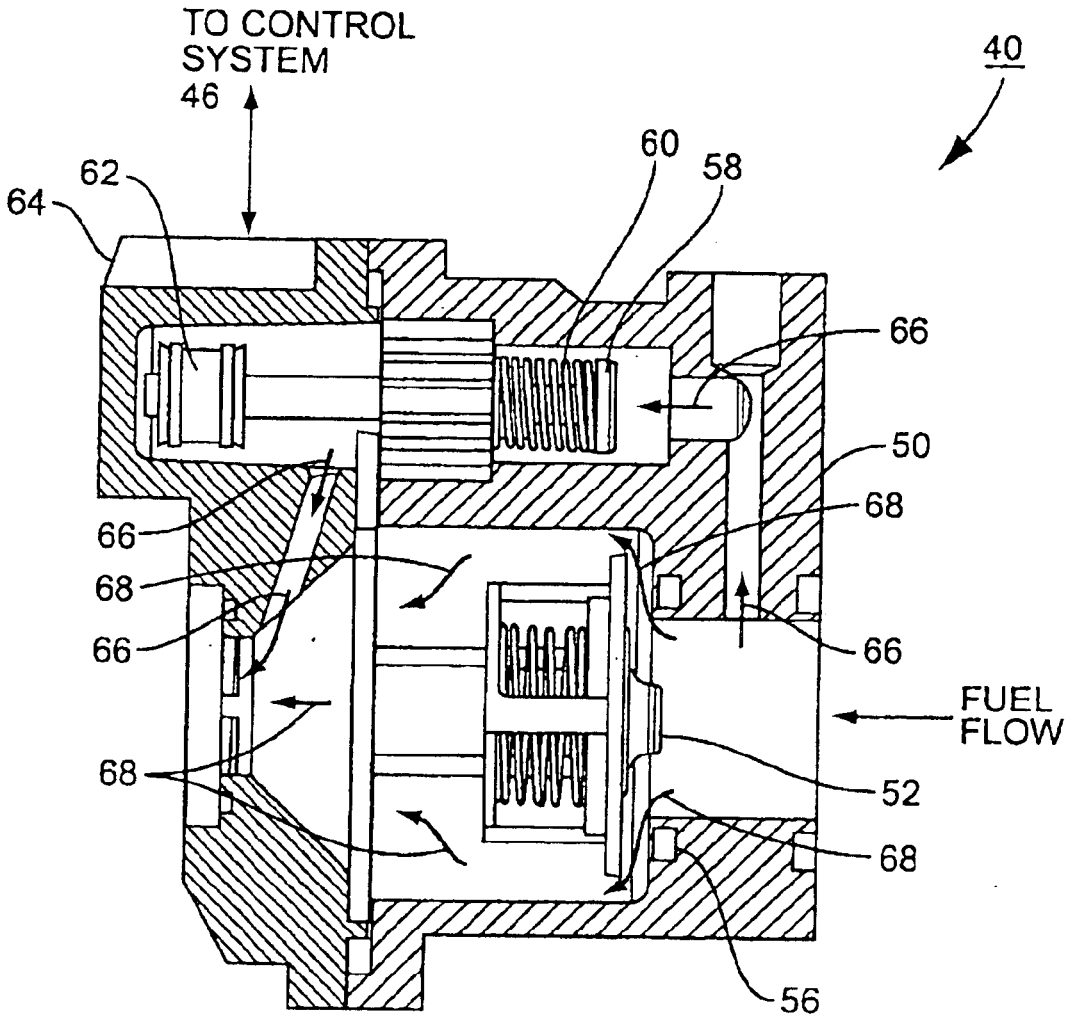
FIG. 7 illustrates the embodiment of FIG. 5 in a third, fully open position.

The valve 40 of the present invention is illustrated in FIGS. 5–7. The valve 40 of FIG. 5 is in a closed position such that no fuel flows through the valve 40. The valve 40 includes a housing 50 that is formed from a material that does not corrode in the presence of hydrocarbons or has been treated to avoid corrosion. A primary piston 52 is positioned within the housing 50. The primary piston 52 is held in its normally closed position by a primary spring 54. An o-ring 56 may be used to help ensure a tight seal between primary piston 52 and housing 50.

A secondary piston 58 is likewise present. The secondary piston 58 is held in its normally closed position by a secondary spring 60. The secondary piston 58 is connected to a position sensible element 62. A sensor 64 is positioned proximate the housing 50 of the valve 40 and is used to sense the position of the position sensible element 62. The sensor 64 communicates with the control system 46 to indicate the position of the secondary piston 58. In an exemplary embodiment, the position sensible element 62 is a magnet and the sensor 64 is a Hall Effect sensor. Alternative position sensible element 62/sensor 64 combinations include, but are not necessarily limited to: magnetic-reed switches, ultrasonic, and capacitive combinations.

The valve 40 will be in the fully closed position illustrated in FIG. 5 when the two-stage valve 37 is closed. This represents those times when no fuel is supposed to flow through the fuel dispenser 14. In a preferred embodiment, the force required to compress the secondary spring 60 is lower than the force required to compress the primary spring 54. Specifically, the secondary spring 60 is adapted to compress during a slow fuel flow condition, such as when the two-stage valve 37 is open to a slow flow mode. The primary spring 54 is adapted to compress during a high fuel flow condition, such as when the two-stage valve 37 is open to a high flow mode.

The valve 40 is illustrated in a partially open mode in FIG. 6. As illustrated, secondary spring 60 has compressed due to pressure on the secondary piston 58. Compression of the secondary spring 60 opens the secondary or bypass fuel path (noted variously by arrows 66). Additionally, the movement of the secondary piston 58 that compressed the secondary spring 60 causes the position sensible element 62 to move such that the sensor 64 detects the movement and sends a signal indicative of the movement to the control system 46. The control system 46, upon receipt of the signal indicating movement of the position sensible element 62, begins accepting input from the flow meter 38 and registering the flow of fuel through the fuel dispenser 14.

The valve 40 is illustrated in a fully open mode in FIG. 7. When the two-stage valve 37 fully opens, the fluid pressure builds up in valve 40 to the point where the primary spring 54 is forced to compress. This opens the primary fuel path (shown variously by arrows 68) and allows fuel to flow through the fuel dispenser 14 at a high flow rate.

Figure 8A:
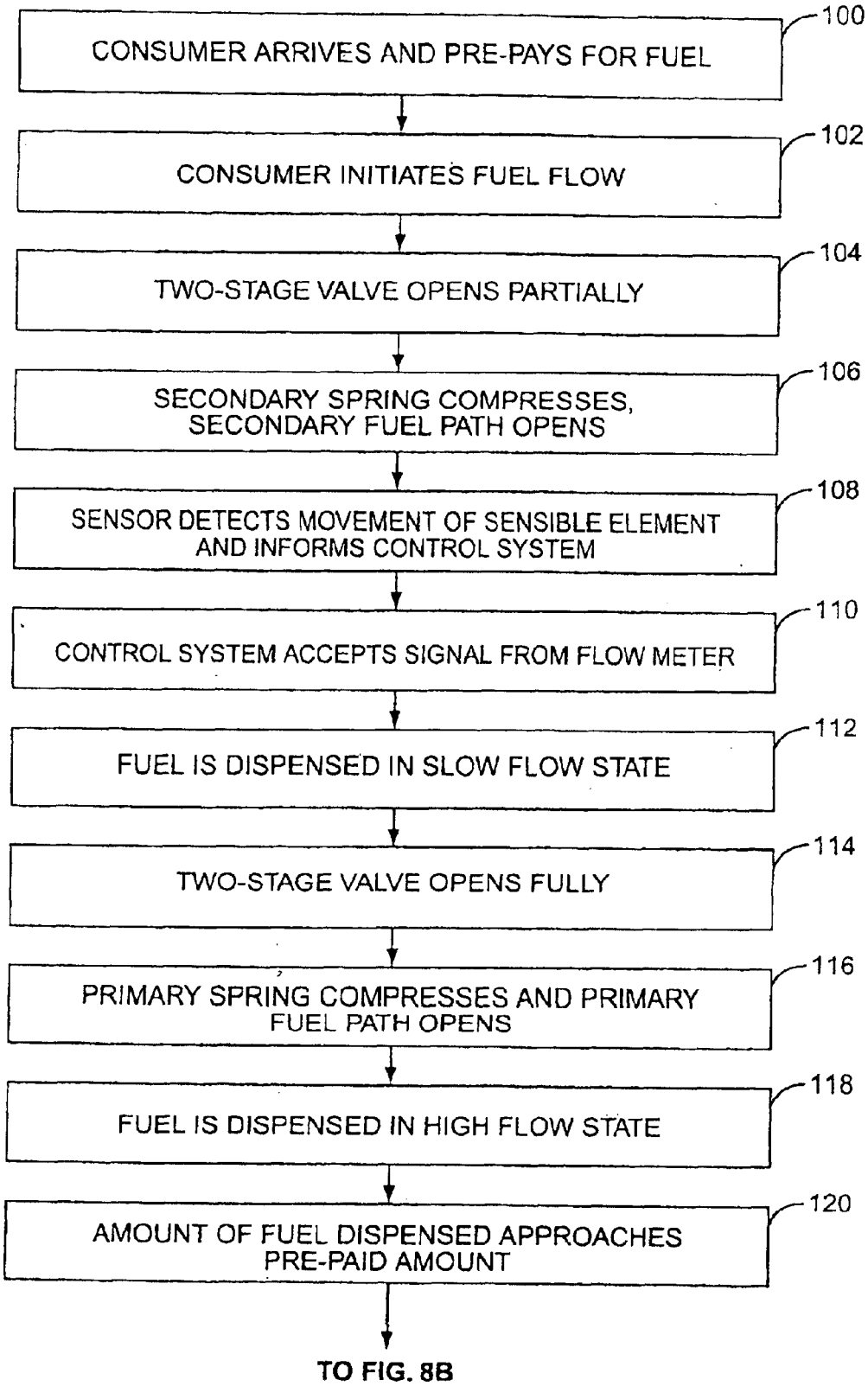
FIGS. 8A and 8B illustrate in a flow chart the process of using the valve of the present invention.
Figure 8B:
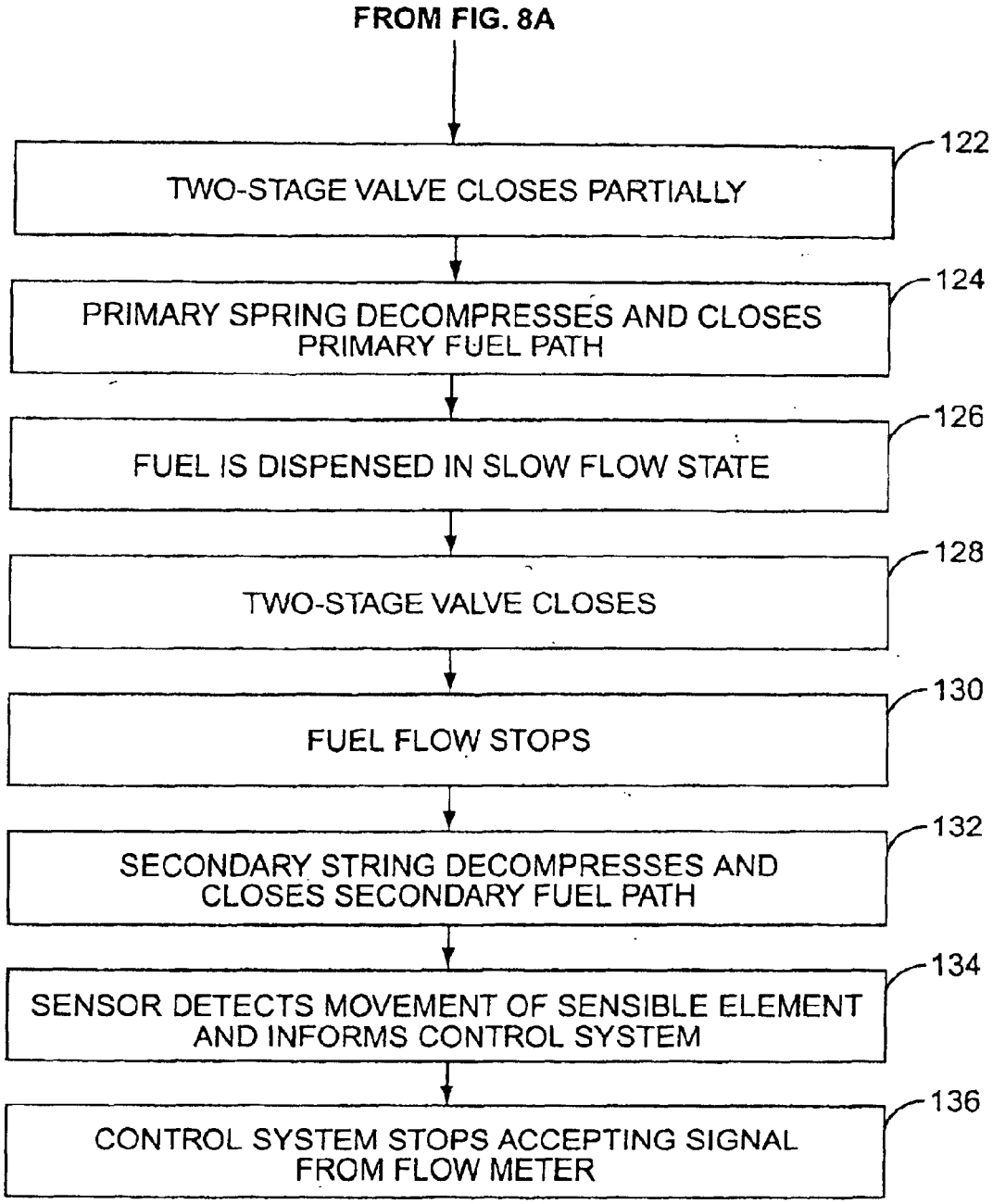

The use of the valve 40 is better explicated with reference to the flow chart of FIGS. 8A and 8B. Initially, a consumer arrives and pre-pays for fuel (block 100). Pre-payment for fuel may be paying for a certain dollar amount of fuel. For example, an individual may wish to pre-pay for ten dollars of fuel. This pre-payment may be by way of credit card, debit card, or cash. In contrast, a non-preset amount of fuel may be purchased. This typically occurs when the consumer desires to fill up the vehicle and is not sure how much fuel may be required to do so. The consumer then inserts the nozzle 20 into the fill neck 22 and initiates fuel flow (block 102), such as by squeezing the handle on the nozzle 20. Squeezing the handle causes the two-stage valve 37 to open partially (block 104). This allows fuel to flow through the fuel dispenser 14 to the valve 40 where it exerts pressure on the primary piston 52 and the secondary piston 58. However the amount of pressure is relatively low, so only the secondary spring 60 compresses, opening the secondary fuel path 66 (block 106). As the secondary fuel path 66 opens, the position sensible element 62 moves and is detected by the sensor 64, which reports the movement to the control system 46 (block 108). The control system 46 begins accepting the input signal from the flow meter 38 (block 110). Fuel is then dispensed in a slow flow state (block 112). Slow flow rates range, in an exemplary embodiment, between zero and two gallons per minute (gpm) and preferably approximately 0.25 gpm.

After a small amount of time, on the order of five seconds or less, the two stage-valve 37 opens fully (block 114). This allows more fuel to flow through the fuel dispenser 14 to the valve 40. The volume of fuel is now great enough to exert enough pressure on the primary piston 52 to cause the primary spring 54 to compress, thereby opening the primary fuel path 68 (block 116). Fuel is then dispensed in a high flow state (block 118).

In due course, the amount of fuel that the fuel dispenser 14 has dispensed will approach that paid for by the pre-payment of block 100 (block 120). As the transaction nears completion, the two-stage valve 37 closes partially (block 122, FIG. 8B). For example, if the consumer paid for ten dollars of fuel, the two-stage valve 37 may close partially when the amount total reaches nine dollars and eighty cents ($9.80). This slows the amount and volume of fuel that reaches the valve 40, thereby reducing the pressure against the pistons 52 and 58. As the pressure has been reduced on the primary piston 52, the primary spring 54 decompresses and closes the primary fuel path 68 (block 124). Fuel continues to be dispensed in the slow flow state (block 126).

The consumer may continue to squeeze the handle on the nozzle 20 as the final ounces of fuel are dispensed into the fill neck 22. Once the pre-paid amount of fuel has been dispensed, the two-stage valve 37 doses (block 128). This stops the flow of fuel to the valve 40 (block 130), thereby reducing the pressure on the pistons 52 and 58. With no pressure on the secondary piston 58, the secondary spring 60 decompresses and closes the secondary fuel path 66 (block 132). The sensor 64 detects the movement of the position sensible element 62 that results from the movement of the secondary piston 58 and informs the control system 46 of the movement (block 134). The control system 46 then stops accepting input from the flow meter 38 (block 136). This prevents spurious signals from the flow meter 38 that may be the result of rotational momentum or the like from being reported as part of a transaction.

Figure 9:
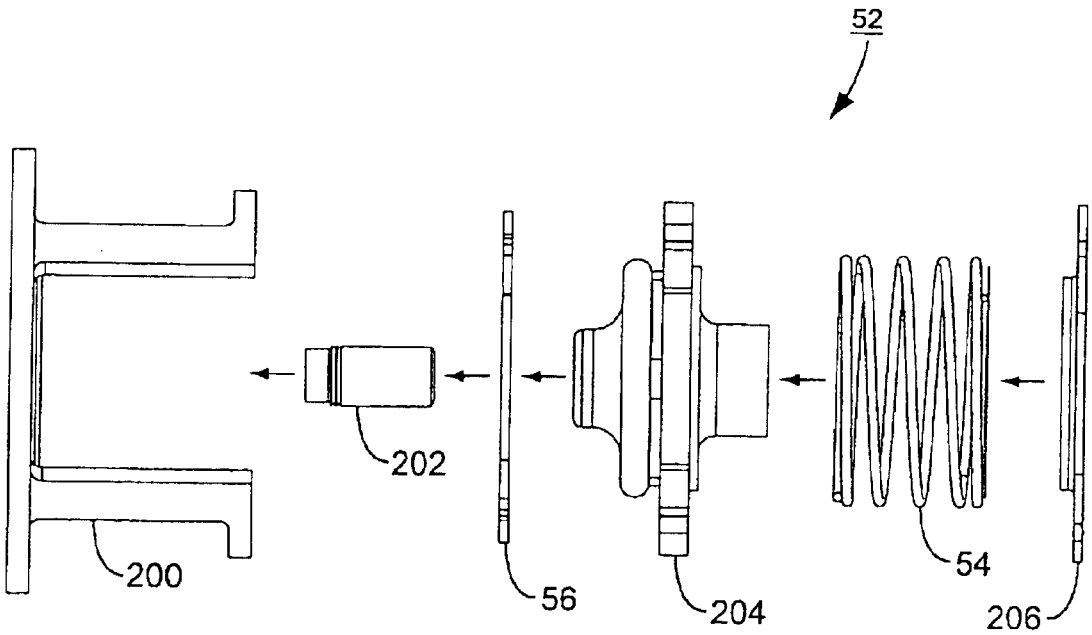
FIG. 9 represents an exploded view of the primary piston with a relief valve illustrated.

It should further be appreciated that the valve 40 may have a relief valve to comply with the appropriate UL requirements for power operated dispensing devices for petroleum products, such as UL 79 paragraph 20.1 and UL 87 paragraph 10.1. More detail on this is seen in FIG. 9. FIG. 9 illustrates an exploded view of the piston 52 into which the relief valve is incorporated. Specifically, piston 52 may be associated with a valve body 200, a relief valve 202, a poppet head 204, the o-ring 56, the primary spring 54 and a washer 206. Thus, the relief valve 202 sits in the middle of the poppet head 204. In an exemplary embodiment, the relief valve 202 has an expanded mandrel set-up as is well understood in the art.

Those skilled in the art will recognize improvements and modifications to the preferred embodiments of the present invention. All such modifications are considered within the scope of the herein and the claims that follow.

What is claimed is:

1. A fuel dispenser comprising:

a two-stage valve adapted to regulate fuel flow into a flow rate selected from the group consisting of: no flow, slow flow and high flow; and a dual piston valve comprising:

a primary piston operative in said high flow rate;

a secondary piston operative in said high flow rate and said slow flow rate;

a position sensible element adapted to move when said secondary piston moves; and a sensor for sensing movement of the position sensible element such that opening and closing of the secondary piston are sensed.

2. The fuel dispenser of claim 1, further comprising a control system adapted to control said two-stage valve and receive input from said sensor.

3. The fuel dispenser of claim 2, further comprising a flow meter operatively connected to said control system.

4. The fuel dispenser of claim 3, wherein said control system receives input from said sensor to determine if said secondary piston is open and refusing input from said flow meter if said secondary piston is not open.

5. The fuel dispenser of claim 3, wherein said flow meter is an inferential flow meter.

6. The fuel dispenser of claim 5, wherein said flow meter is an inferential turbine flow meter.

7. The fuel dispenser of claim 2, wherein said dual piston valve further comprises a primary spring associated with said primary piston and a secondary spring associated with said secondary piston, both springs adapted to maintain respective pistons in a normally closed position.

8. The fuel dispenser of claim 2, wherein said sensor comprises an element selected from the group consisting of: a Hall Effect sensor, an ultrasonic sensor, a capacitive sensor, and a magnetic reed switch arrangement.

9. The fuel dispenser of claim 2, wherein said dual piston valve further comprises a relief valve adapted to relieve pressure when said dual piston valve is closed.

10. The fuel dispenser of claim 9 wherein said relief valve is associated with said primary piston.

* * * * *